US006145944A

United States Patent [19]

Bayani et al.

[11] Patent Number: 6,145,944

[45] Date of Patent: Nov. 14, 2000

[54] SLIDE DETENT DEVICE

[75] Inventors: Eman Bayani, Fullerton; Avi Bilu, Diamond Bar, both of Calif.

[73] Assignee: Accuride International, Inc., Santa Fe Springs, Calif.

[21] Appl. No.: 09/267,425

[22] Filed: Mar. 12, 1999

[51] Int. Cl.[7] ..... A47B 88/16

[52] U.S. Cl. ..... 312/334.44; 312/334.11

[58] Field of Search ..... 312/334.44, 334.46, 312/330.1, 333, 334.7, 334.8, 334.11, 334.17; 384/18, 20, 21

[56] References Cited

U.S. PATENT DOCUMENTS

| | | | |
|---|---|---|---|
| 2,012,530 | 8/1935 | Eustis | 312/334.6 |
| 3,588,198 | 6/1971 | Stewart | 312/344.11 X |
| 3,801,166 | 4/1974 | York | 312/334.44 X |
| 3,876,263 | 4/1975 | Oleksiak | 312/334.44 X |
| 4,183,596 | 1/1980 | Greene et al. | 312/334.11 X |
| 4,469,384 | 9/1984 | Fler et al. | 312/334.11 X |
| 4,605,265 | 8/1986 | Bessinger et al. | 384/20 |
| 5,466,060 | 11/1995 | Hoffman | 312/334.44 X |
| 5,577,821 | 11/1996 | Chu | 312/334.11 |
| 5,624,171 | 4/1997 | Soja et al. | 312/334.8 |
| 5,671,988 | 9/1997 | O'Neill | 312/334.44 |

FOREIGN PATENT DOCUMENTS

| | | | |
|---|---|---|---|
| 255136 | 8/1995 | China . | |
| 367274 | 5/1990 | European Pat. Off. | 312/334.11 |
| 2707365 | 8/1978 | Germany | 312/334.44 |

*Primary Examiner*—Peter M. Cuomo
*Assistant Examiner*—James O. Hansen
*Attorney, Agent, or Firm*—Christie, Parker & Hale, LLP

[57] ABSTRACT

A drawer slide with a detent mechanism which provides a detent-in, detent-out and midway detent function. Detent bumpers are coupled to slide members of a drawer slide. The detent bumpers engage protrusions located on other slide members at points along the length of travel of the drawer slide so as to provide a frictional interface. In one embodiment the protrusion is formed by use of an opposing detent bumper.

13 Claims, 9 Drawing Sheets

SLIDE DETENT DEVICE

BACKGROUND OF THE INVENTION

This invention relates generally to drawer slides, and more particularly to drawer slides having detent mechanisms.

Drawer slides for file drawers, shelves, and the like are often desirable for use in cabinets, desks, and rack-mounted applications. Such slides permit easy access to the interior of a drawer or to the top of a shelf. The slides maintain the drawer or shelf in a horizontal position regardless of how far the drawer or shelf is withdrawn from the cabinet or desk.

A typical drawer slide has two or three slide members slidably coupled by sets of bearings, which are often ball bearings. The bearings generally roll in raceways formed on the slide members. The slide member attached to the cabinet or desk, which may be viewed as a stationary frame, generally comprises a longitudinally elongated substantially planar web with bearing raceways extending from the margins of and along the length of the web. The slide member attached to the drawer or shelf, which may be viewed as a moveable object, also generally comprises a longitudinally elongated substantially planar web with bearing raceways along the length of the web extending from the margins of and along the length of the web.

In a three-drawer slide, an intermediate member is disposed between the slide member attached to the stationary frame and the slide member attached to the moveable object. The intermediate member is sometimes similarly shaped, depending on the type of drawer slide, as drawer slides come in a variety of types. For example, in a telescopic drawer slide, the slide members are generally nested within one another and the intermediate slide member is substantially similar to the other slide members. In an over and under drawer slide, however, two of the drawer slides are arranged in a vertical plane, and the intermediate drawer slide member generally has a pair of offset webs connected by a connecting member.

When drawer slides are used to extensibly mount a cabinet or shelf with respect to a stationary frame, it is often desirable to partially restrain movement of the drawer slide members with respect to one another when the drawer slide members are in pre-defined positions. For example, it is often desirable to partially restrain movement of the drawer slide members when the cabinet or shelf is in a retracted position with respect to the stationary frame. Such a partial restraint is sometimes termed a detent-in, as opposed to a detent-out which is a partial restraint in a fully extended position. Without such a partial restraint, the shelf or drawer may inadvertently extend due to the stationary frame being mounted on an uneven floor, the drawer slides being installed at slight angles, or possibly vibration of the stationary frame. Similarly, at times it is desirable to partially restrain movement of the shelf or drawer when the shelf or drawer is partially extended, or fully extended, from the stationary frame.

Partial restraint of movement of the drawer slides may be accomplished by providing a frictional interface between the drawer slide members. For example, a frictional interface may be formed on a telescopic drawer slide by using a stop bumper, which is an internal bumper mounted on an upturned flange at the end of a web of an outer drawer slide member and by decreasing the distance between the raceways at an end of the inner slide member. With such an arrangement, the bearing raceways of the inner slide member may contact the stop bumper on the web of the outer slide member so that increased force is required to place the slide in a retracted position or to extend the slide. Such an arrangement, however, suffers from the defect that the detent positions are limited to the extremes of the drawer slide travel, i.e. to a detent-in or a detent-out. Further, a single bumper can not be used to provide both a detent-in and a detent-out function. In addition, over time the contact between the bearing raceways and the stop member may deteriorate the ability of both to perform their required functions. Furthermore, such arrangements are not necessarily usable with slides, such as parallel drawer slides, other than telescopic drawer slides.

SUMMARY OF THE INVENTION

Accordingly, the present invention provides a drawer slide with detent mechanism usable on parallel drawer slides, and which provides a detent function at various locations along the travel path of the drawer slide. In one embodiment the drawer slide with a detent mechanism comprises a first slide member with a first bumper. A second slide member is slidably coupled to the first slide member. When the first slide member is in a predefined position with respect to the second slide member the first bumper of the first slide member contacts a protrusion. The protrusion is an emboss formed on the second slide member in one embodiment. In another embodiment the protrusion is part of a second bumper coupled to the second slide member. The slide members slidably move from a retracted position with respect to one another and an extended position with respect to one another, and are slidably extendable from their retracted position to the extended position along a travel path.

In one embodiment the drawer slide with a detent comprises a first drawer slide, a second drawer slide slidably coupled to the first drawer slide, and means coupled with the first drawer slide to restrain motion of the second drawer slide. Further, in another embodiment the drawer slide with a detent comprises first and second slide members coupled by bearings riding in bearing raceways. An end piece is attached to one of the slide members. The end piece includes a flange extending into the bearing raceway so as to contact a bearing and thereby provide a frictional interface.

Many of the attendant features of the this invention will be more readily appreciated as the same becomes better understood by reference to the following detailed description considered in connection with the accompanying drawings.

DETAILED DESCRIPTION

Figures 1, 2:
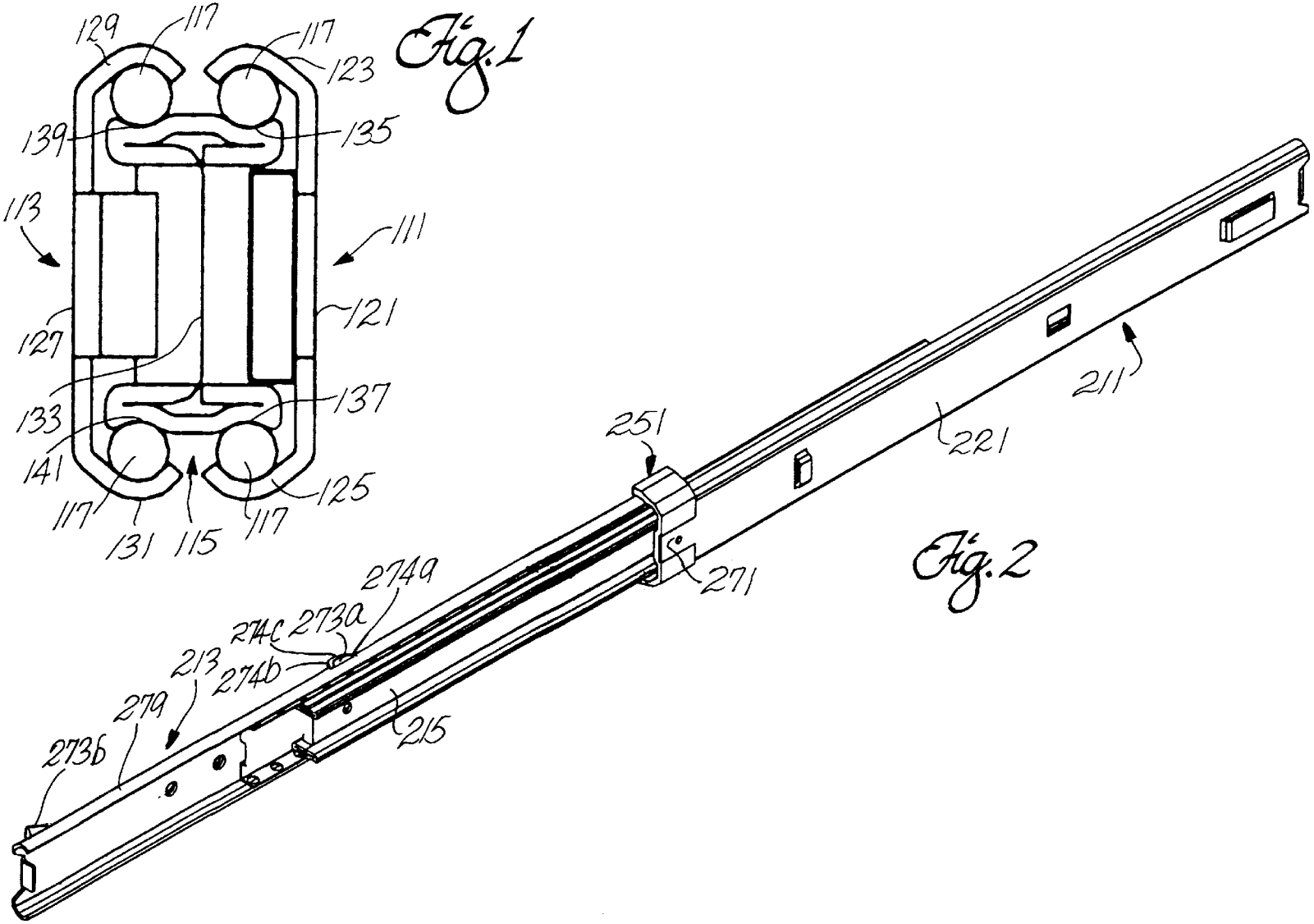
FIG. 1 illustrates a cross-section of a parallel drawer slide.
FIG. 2 illustrates a perspective view of a parallel drawer slide incorporating an embodiment of a detent mechanism including a detent bumper of the present invention.

FIG. 1 illustrates a cross section of a parallel slide. The parallel slide as a whole is illustrated in FIG. 2. As illustrated in FIG. 1, the parallel slide is a three-member slide having a first slide member 111 facing an opposing slide member 113. An intermediate slide member 115 is disposed between the first slide member and the opposing slide member. The first slide member and the opposing slide member each have substantially planar webs with bearing raceways extending from the margins of the webs, with the raceways having end portions directed to one another. For convenience of description the drawer slide of FIG. 1, as well as the items in other figures, are described with relative directions, i.e., up, down, horizontal, vertical, etc., with respect to their orientations as illustrated. Thus, the first slide member and the opposing slide member are disposed horizontally with respect to one another as illustrated in FIG. 1. It should be recognized, however, that in use the drawer slide of FIG. 1 may be mounted such that the first and opposing slide members are vertically disposed with respect to one another. Thus, the first slide member has a planar web 121, with an upper bearing raceway 123 and a lower bearing raceway 125 extending from the upper and lower margins, respectively, of the web. Rollably riding in the bearing raceways are bearings 117. As illustrated, the bearings are ball bearings.

Similarly, bearings 117 ride in an upper raceway 129 and a lower raceway 131 of the opposing slide member. Interconnecting the upper raceway and lower raceway of the opposing slide member is a substantially planar web 127. The raceways 129, 131 therefore extend from the upper and lower margins, respectively, of the web 127. Moreover, the raceways extend toward the raceways of the first slide member. Accordingly, the first and second slide members are largely mirror images of each other.

Disposed between the first and opposing slide members is an intermediate slide member. The intermediate slide member has a central web 133. A pair of upper raceways 135, 139 are formed along the top margin of the central web, and a pair of lower raceways 137, 141 are formed along the lower margin of the central web. The bearing raceways are formed on the uppermost and lowermost surfaces of the intermediate member. Moreover, each pair of raceways, that is the upper raceways and the lower raceways, are parallel and slightly offset horizontally from one another. As illustrated, the intermediate member is formed of a single piece of metal, with the raceways formed by appropriately bending the single piece of metal. For example, the margins of the piece of metal may be first bent in a one direction to form an extension, and then doubled over twice the distance of a first extension in a second direction before being doubled over once again to have the edge of the metal in contact with the web of the intermediate member. Other methods of forming an intermediate slide member, however, are well known in the art.

The bearings riding in the upper raceway of the first slide member are also rollably riding in the upper bearing raceway 135 of the intermediate slide member. The bearings riding in the lower raceway of the first slide member are also rollably riding in the lower bearing raceway 137 of the intermediate slide member. Similarly, the bearings riding in the upper and lower raceways of the opposing slide member are also rollably riding in the corresponding upper and lower raceways 139, 141 of the intermediate member.

FIG. 2 illustrates a perspective view of a parallel drawer slide. As in FIG. 1, a first slide member 211 is slidably connected to an opposing slide member 213 by bearings (not shown) and an intermediate slide member 215. The first slide member has a planar web 221, with a tongue portion 271 at one longitudinal end of the web. Coupled to the first slide member at the tongue is a detent bumper 251. The detent bumper largely mirrors the cross sectional shape of the first slide member, but is constructed so as to contact embosses 273*a,b* extending from an outer surface of an upper raceway 279 of the opposing slide member.

Figure 3:
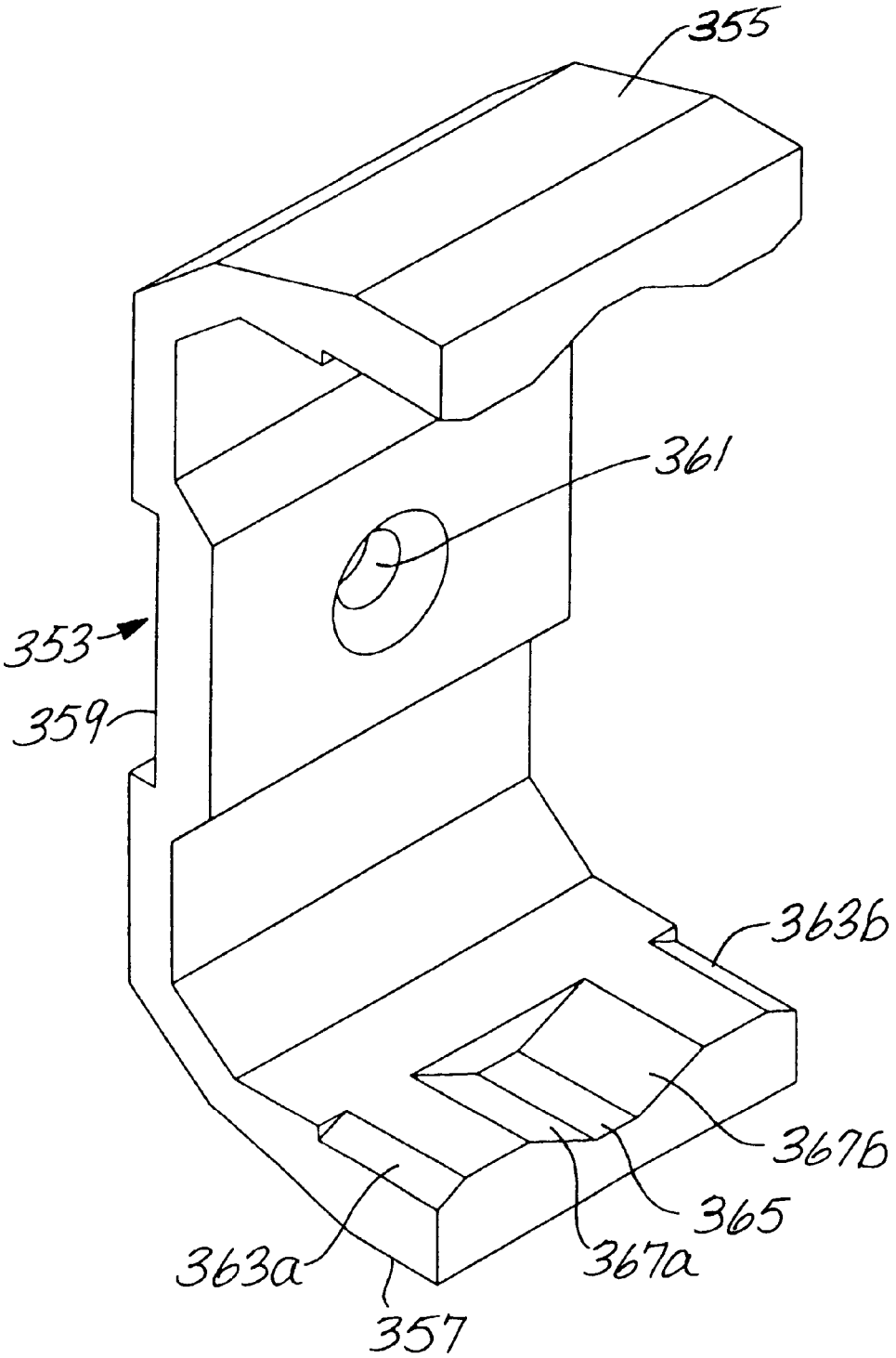
FIG. 3 illustrates a perspective view of the detent bumper of FIG. 2.

Details of the detent bumper 251 of FIG. 2 may be seen in FIG. 3, which is a perspective view of the detent bumper of FIG. 2. The detent bumper has a web 353, with an upper flange 355 and a lower flange 357 extending from the upper and lower margins, respectively, of the web. The flanges extend to a distance sufficient such that when the bumper is mounted to a first slide member portions of the flanges may contact embosses on an opposing slide member. A rectangular cutout 359 is formed in the web so as to be adapted to allow a tongue, such as the tongue 271 of FIG. 2, to be placed in the cutout. The web further includes an aperture 361 to allow the bumper to be attached to the tongue using a rivet, screw, or other connecting means. Mounting the detent bumper to a slide member using a tongue provides increased positional stability for the detent bumper, as well as reduces strain on any fastening member while also allowing the detent bumper to not extend outwardly from the web of the slide member, thereby reducing the width of the drawer slide as a whole.

The detent bumper is symmetrical about its vertical midpoint. Therefore, it should be understood that discussion relating to one flange applies equally to the opposing flange. The flanges of the bumper are adapted to receive embosses in a receiving cup 365 located in an inner surface of the lower flange. In addition, the inner surface of the flange has chamfered edges 363*a,b* to more easily allow the flange to ride over an emboss so that the flange may receive the emboss in the receiving cup. The receiving cup is located approximately midway between the chamfered edges, and is formed such that sloped edges 367*a,b* lead to a flat recessed surface 365 in the flanges. The angles of the chamfered edges and the sloped surfaces may be varied to provide differing degrees of frictional interfaces depending on the size and shape of any embosses on the opposing slide member. In addition, the material of which the flange is formed may also be varied to modify the frictional interface.

In one alternative embodiment a receiving cup is located on an outer surface of the lower flange, with the outer surface of the flange having chamfered edges. This allows the bumper to be used in, for example, an over and under slide with embosses or other protrusions formed on a connecting member of an intermediate member.

Interaction of the detent bumper with embosses may be more fully described with respect to operation of the slide of FIG. 2, and more particularly with respect to operation of the detent bumper and an the emboss 273*a* located approximately midway along the opposing slide. As illustrated, the emboss located approximately midway along the opposing slide is somewhat triangular in shape in that it has a first upper surface 274*a* which rises gently from the outer surface of the upper bearing raceway to an apex 274*c,* followed by a second upper surface 274*b* which descends steeply back to the surface of the drawer slide. As the second drawer slide travels from the extended position illustrated in FIG. 2 towards a closed retracted position, the emboss located approximately midway along the opposing slide contacts the detent bumper. This contact first occurs along one of the chamfered edges of the flange of the detent bumper when the gently sloping surface of the emboss contacts the flange.

The ease at which the flange rides over the emboss depends on the height of the emboss and the relative angles of the gently sloping surface of the emboss and the chamfered edge of the flange, with a gently sloping surface requiring less force to overcome as opposed to a steeply sloping surface. Thus, in the slide of FIG. 2 the frictional interface formed by the bumper and the emboss midway along the second slide requires little force to overcome when a drawer slide is being retracted as compared to the force required to overcome the frictional interface formed between the steeply sloping surface of the emboss and the flange as the drawer slide is being extended. Accordingly, by varying the height and the various angles of the emboss and the flange, the force required to overcome the frictional interfaces may be changed.

Figure 6:
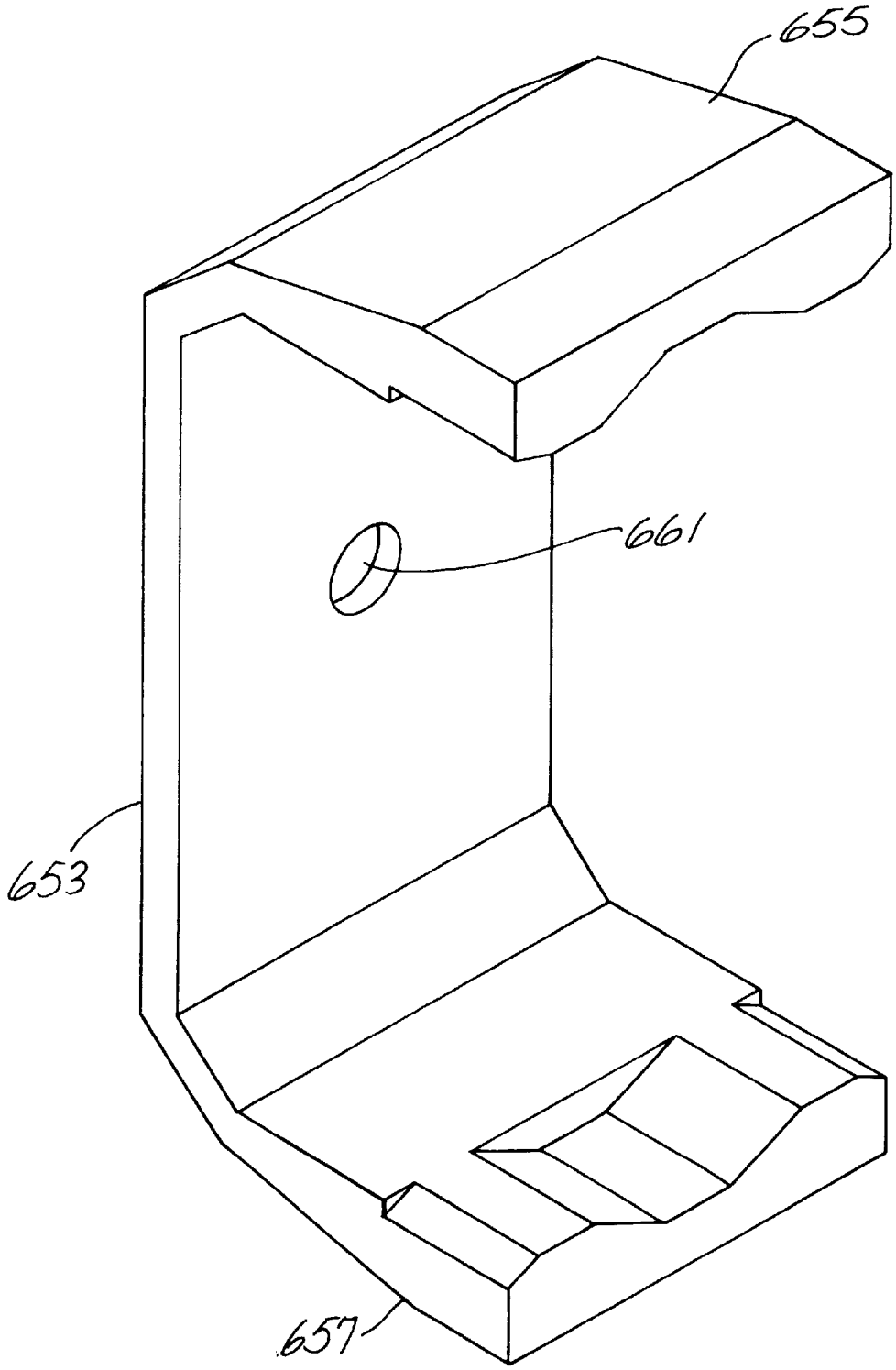
FIG. 6 illustrates a further embodiment of a detent bumper of the present invention.

FIG. 6 illustrates a perspective view of another embodiment of the detent bumper of FIG. 3. As in the embodiment of FIG. 3, the detent bumper of FIG. 6 has a web 653 with an upper flange 655 extending from the upper margin of the web and a lower flange 657 extending from the lower margin of the web. The web includes an aperture 661 adapted to receive a rivet or the like. Unlike the embodiment illustrated in FIG. 3, the detent bumper of FIG. 6 does not have a cutout so as to be adapted to receive a tongue of a web of a slide member. Instead, the detent bumper of FIG. 6 is mounted to the outside of the web of the slide member. An advantage of the detent bumper of FIG. 6, particularly with respect to the lack of a cutout in the web, is that manufacturing operations with respect to the slide member and the detent bumper are reduced.

Figure 4:
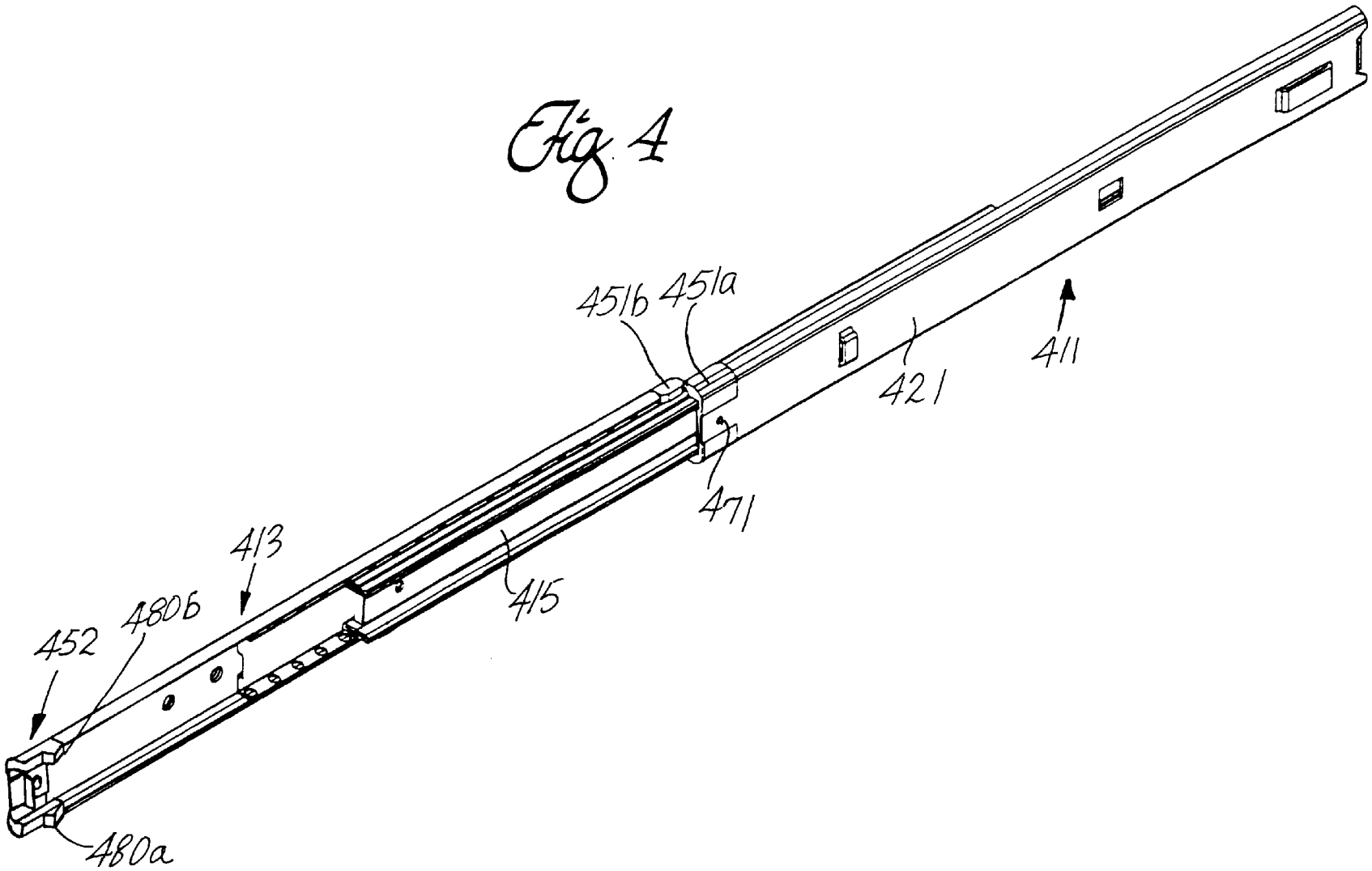
FIG. 4 illustrates a perspective view of a parallel drawer slide incorporating a further embodiment of the detent mechanism including a detent bumper of the present invention.

FIG. 4 illustrates a perspective view of a parallel slide including another embodiment of the invention. As in the embodiment of FIG. 2, a detent bumper is coupled to a web 421 of a first slide member 411 at a tongue 471 of the web. The first slide member is slidably coupled to a second opposing slide member 413 by bearings (not shown) and an intermediate slide member 415. The detent bumper 451*a,* unlike the detent bumper of FIG. 2, does not extend over the bearing raceways of the opposing slide member. Instead, the detent bumper 451*a* extends horizontally towards the bearing raceways of the opposing slide member so as to be adapted to contact a horizontal protrusion on the bearing raceway of the opposing slide member. This protrusion may be formed by an emboss, or, as illustrated in FIG. 4, by installing a detent bumper 451*b* on the opposing slide member, with the detent bumper 451*b* being similarly shaped to the detent bumper 451*a.*

In addition, the protrusion on the opposing slide member may also be formed using the structure of an emboss formed on an end piece. As illustrated, the opposing slide member has such an end piece 452. The end piece has a cross section substantially similar to the opposing slide member, and is coupled to the opposing slide member in the same manner as the detent bumper. Extending horizontally from the end piece, and adjacent the bearing raceways of the opposing slide member, are catches 480*a,b.* The catches have an external surface similar to that described with respect to the emboss midway along the opposing slide member of FIG. 2.

Figure 5:
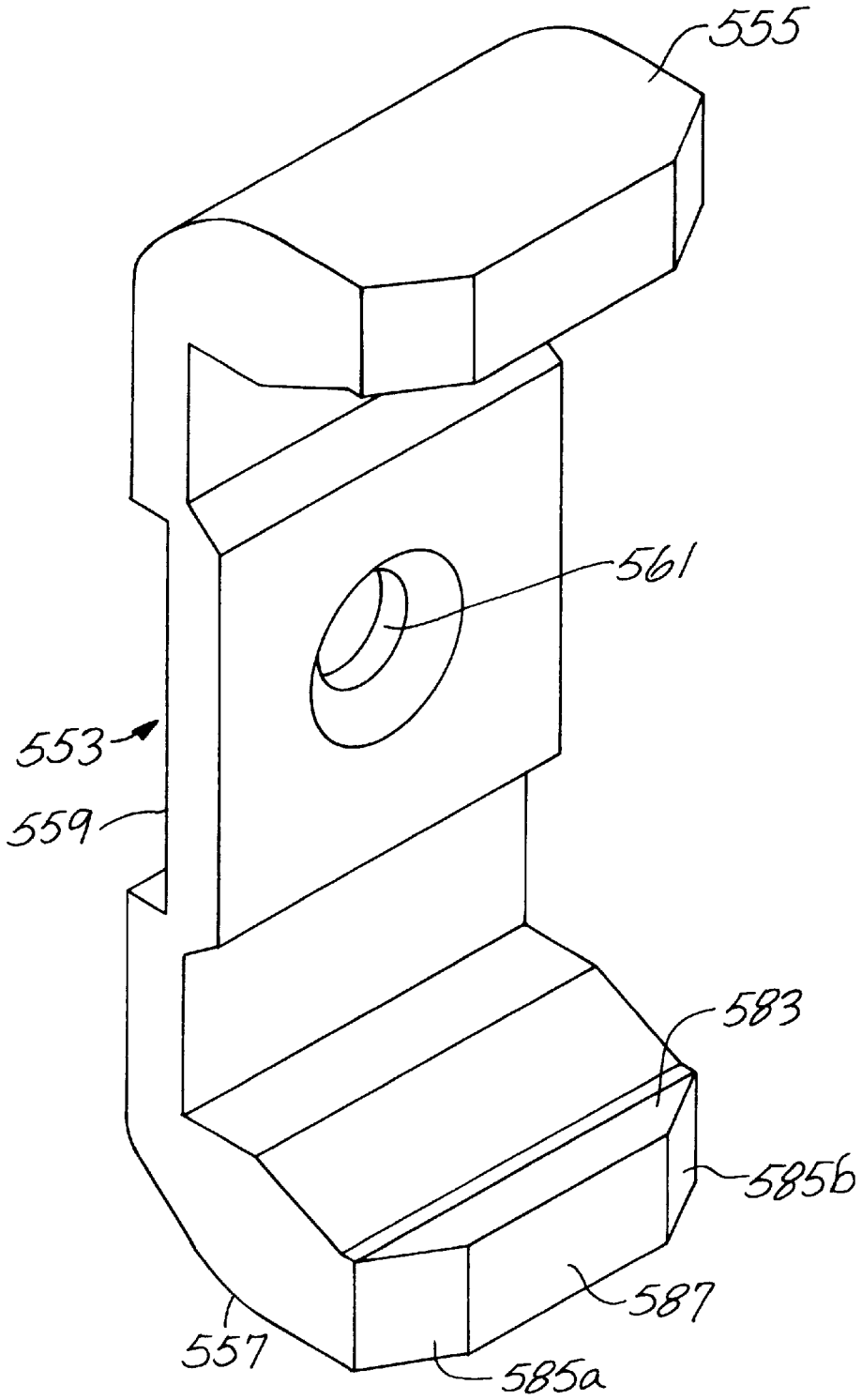
FIG. 5 illustrates a perspective view of the detent bumper of FIG. 4.

FIG. 5 illustrates details of the detent bumper 451*a* of FIG. 4. As with the detent bumper of FIG. 3, the detent bumper of FIG. 5 includes a web 553 with an upper flange 555 and a lower flange 557 extending from the upper and lower margins, respectively, of the web. The web has a cutout 559 adapted to receive a tongue of a web of a slide member, as well as an aperture 561 in the middle of a web adapted to receive a rivet or other fastening means.

Use of the cutout 559 allows the detent bumper to have a shape more closely aligned with the dimensions of the slide member when installed with the slide member. The cutout also provides additional positional stability to the detent bumper when installed with a slide member so as to reduce the possibility of twisting of the detent bumper. Furthermore, as shown in FIG. 4, contact of the detent bumper against an emboss or opposing detent bumper induces a force on the detent bumper in the direction away from the opposing slide member. Attachment of the detent bumper to the web of the first slide member by placing the tongue in the cutout provides increased resistance to such force as compared to merely attaching, using a rivet or similar means, the detent bumper to the first slide member with the detent bumper wrapped around the outer edges of the slide member.

The flanges of the detent bumper of FIG. 5 additionally include an extension 583. The extension 583 extends horizontally from the end of the flange. Thus, when installed on a first slide member of a parallel slide, the extension extends in the direction of the opposing slide member. In some embodiments, the extension extends sufficiently far so as to be in constant contact with the end of the flanges forming the bearing raceways on the opposing slide member. This provides an increased level of friction, or damping, in the movement of the slide as a whole.

The extension has a forward face formed of chamfered edges 585*a* and 585*b* leading to an edge surface 587. The chamfered edges allow the detent bumper to more easily ride over a protrusion such as an emboss or that formed by an opposing detent bumper. As the detent bumper rides over such a protrusion, the detent bumper flexes about its point or points of contact with the slide member to which it is attached. As some force is required to flex the detent bumper, this force results in increased friction between the detent bumper and the protrusion, thus forming a frictional interface. A benefit of a design of the detent bumper of FIG. 5, as opposed to the detent bumper of FIG. 3, is that the detent bumper of FIG. 5 is contained within the vertical footprint of the slide member, thereby reducing the vertical space required by the slide.

Figure 7:
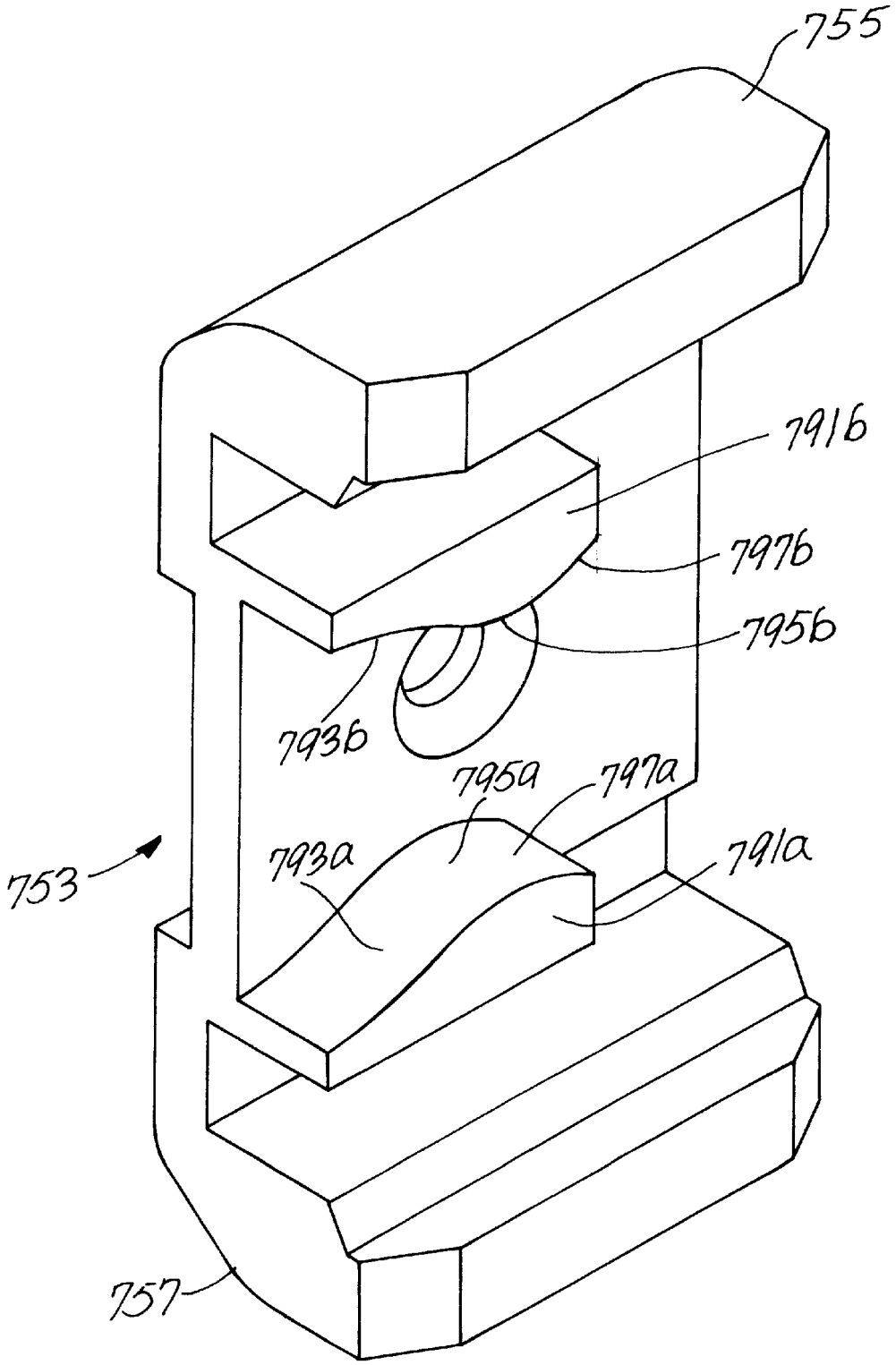
FIG. 7 illustrates a perspective view of a further embodiment of a detent bumper of the present invention.

FIG. 7 illustrates another embodiment of the detent bumper of FIG. 5. The detent bumper of FIG. 7 has a web 753 with an upper flange 755 extending from the upper margin of the web and a lower flange 757 extending from the lower margin of the web. The detent bumper of FIG. 7 is largely similar to the detent bumper of FIG. 5, but includes additional features. In particular, the detent bumper of FIG. 7 includes mated grips 791*a,* 791*b* on the inner portion of the web, with the mated protrusions defining a slot adapted to receive an internal bumper mounted on a slide member. The protrusions have opposing surfaces formed of a gently sloping surface 793*a,b* leading to an apex 795*a,b.* On the other side of the apex 795*a,b* is a second gently sloping surface 797*a,b.* Operation of the detent bumper of FIG. 7 with respect to the protrusions forming a slot adapted to receive an internal bumper may be discerned with respect to FIG. 8.

Figure 8:
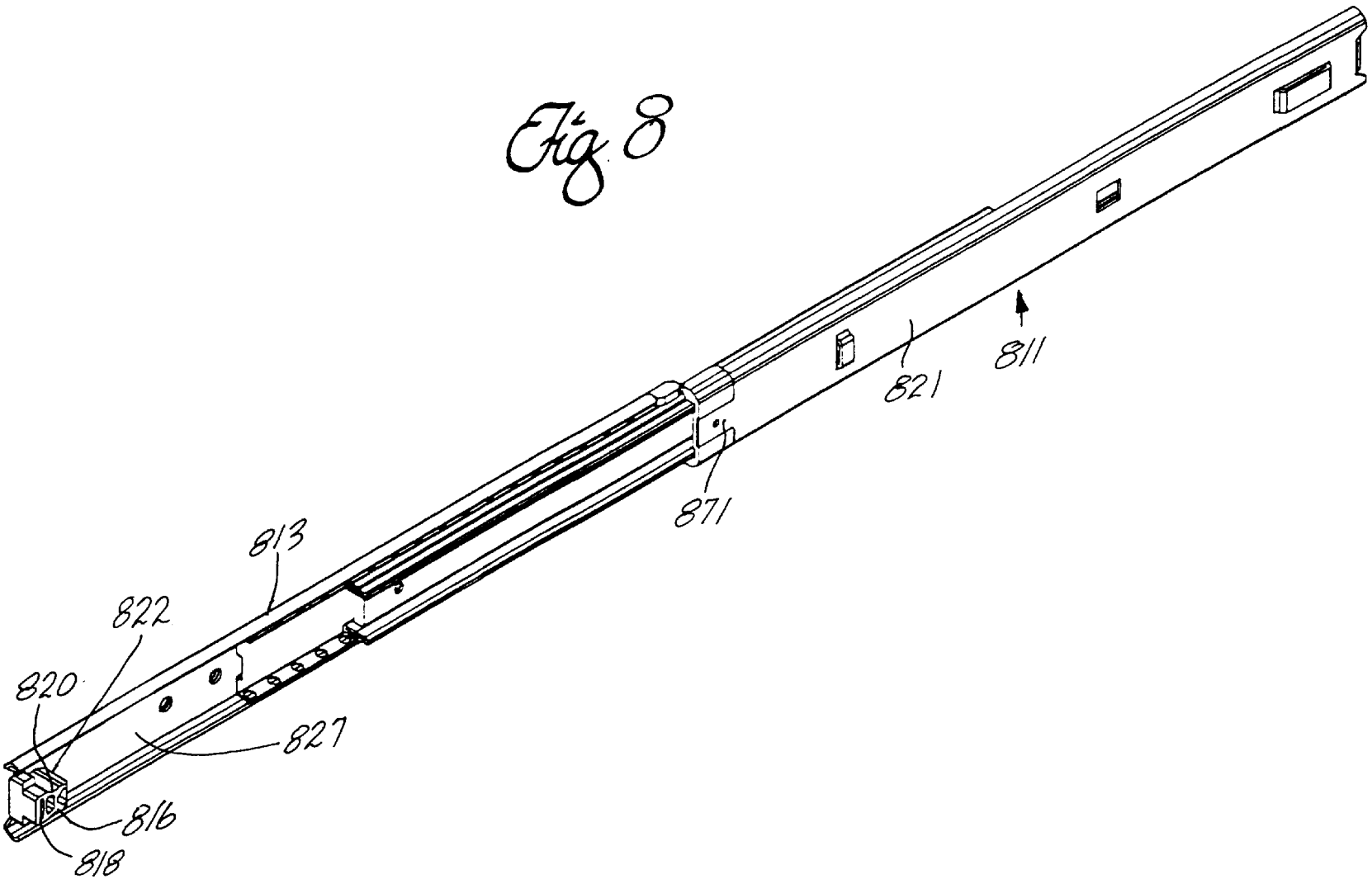
FIG. 8 illustrates a perspective view of a parallel drawer slide incorporating a further embodiment of the present invention.

FIG. 8 illustrates the detent bumper of FIG. 7 mounted to a web 821, and more particularly a tongue 871 of the web 821, of a slide member 811. Mounted to a web 827 of an opposing slide member 813 is an internal bumper 816. The internal bumper is substantially block shaped with an aperture 818 near one end adapted to receive a turned up tab from the web. The internal bumper 816 has an area of reduced cross section 820 in the middle of the internal bumper. Extending longitudinally from this area of reduced cross section is an area of increased cross section 822. As the detent bumper approaches the internal bumper the gently sloping surface 793*a* (illustrated in FIG. 7) contacts the area of increased cross section 822 of the internal bumper. This contact requires that additional force be applied to the slide to fully retract the slide. As the slide is further retracted, the area of increased cross section 822 rides over the apex 795*a,b* of the protrusions until the apex of the protrusions are disposed in the area of decreased cross section 820. Thus, the protrusions and the internal bumper form a detent in mechanism.

Figure 9:
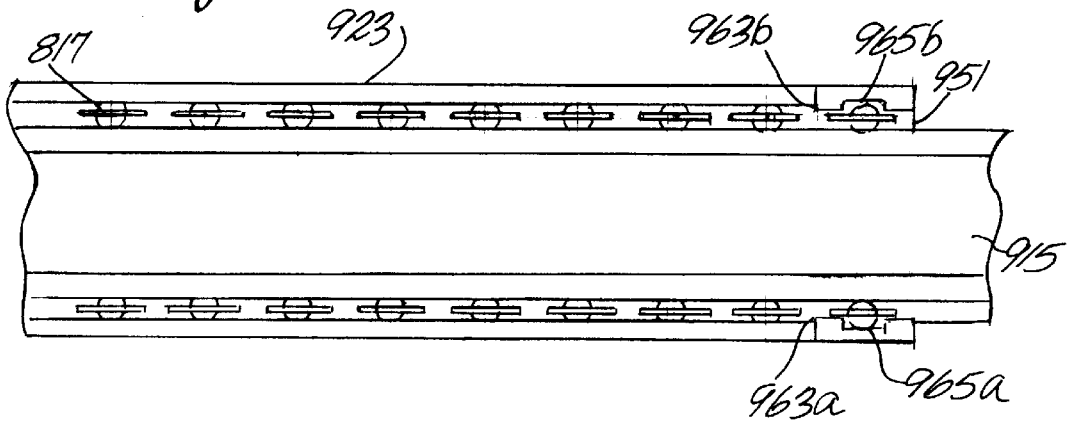
FIG. 9 illustrates a planar view of a parallel drawer slide including an end piece of yet another further embodiment of the present invention.

FIG. 9 illustrates a planar view of a partial parallel drawer slide including another embodiment of the present invention. The parallel drawer slide is not complete as one of the two outer opposing slide members is removed. As illustrated, bearings 817 rollably ride in a bearing raceway 923 of a first slide member. The bearings rollably contact an intermediate slide member 915. Coupled to one longitudinal end of the first slide member is an end piece 951.

Figure 10:
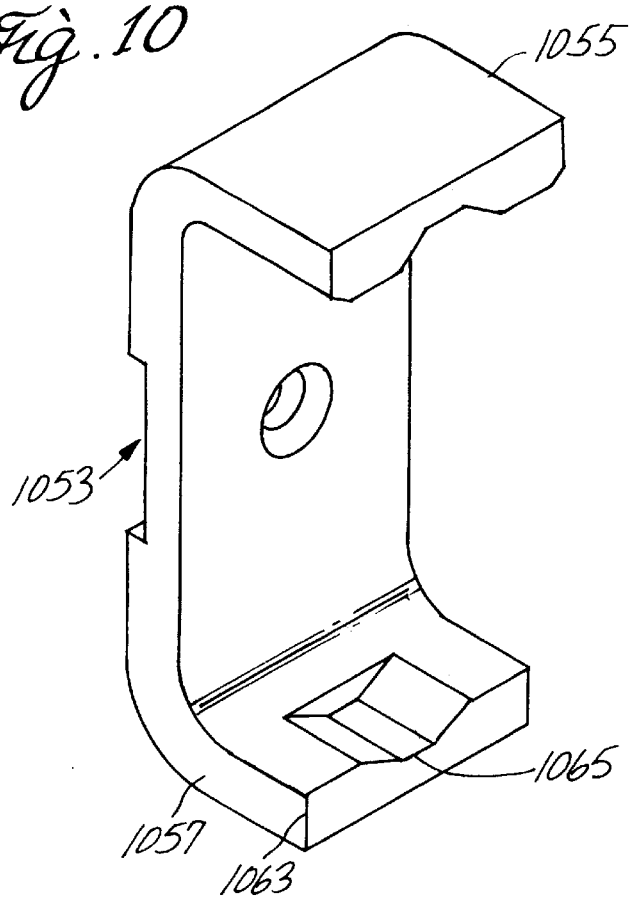
FIG. 10 illustrates the end piece of FIG. 9.

Details of the end piece are illustrated in FIG. 10. The end piece has a substantially planar web 1053 with an upper flange 1055 and a lower flange 1057 extending from the upper and lower margin, respectively, of the web. The distance between the flanges is slightly less than the distance between the bearing raceways on the slide member. Inset in the flanges is an indentation 1065. The indentation is adapted to receive a ball bearing.

In one alternate embodiment the flange extends outward along the outer surface of the raceway, with an indentation in the outer surface of the flange. The indentation is adapted to receive a bearing in a raceway formed on an outer surface of, for example, an inner or intermediate slide member of a telescopic drawer slide. Accordingly, a frictional interface or a bearing retainer function may be provided. Further, with use of a bumper of a shape substantially matched in dimension to that of an inner or intermediate slide member the end piece may be used throughout the length of the slide member.

Returning now to FIG. 9, it may be seen that the edge 963*b* of the end piece 951 protrudes into the ball bearing raceway. Thus, as a ball bearing reaches the end piece increased force must be applied to move the slide so as to force the bearing over the edge of the end piece. Once the bearing reaches the indentation 965*b,* the bearing thereafter requires additional force to move the bearing out of the indentation. Accordingly, the end piece, in conjunction with the bearing, provides a detent function for the slide.

Figure 11:
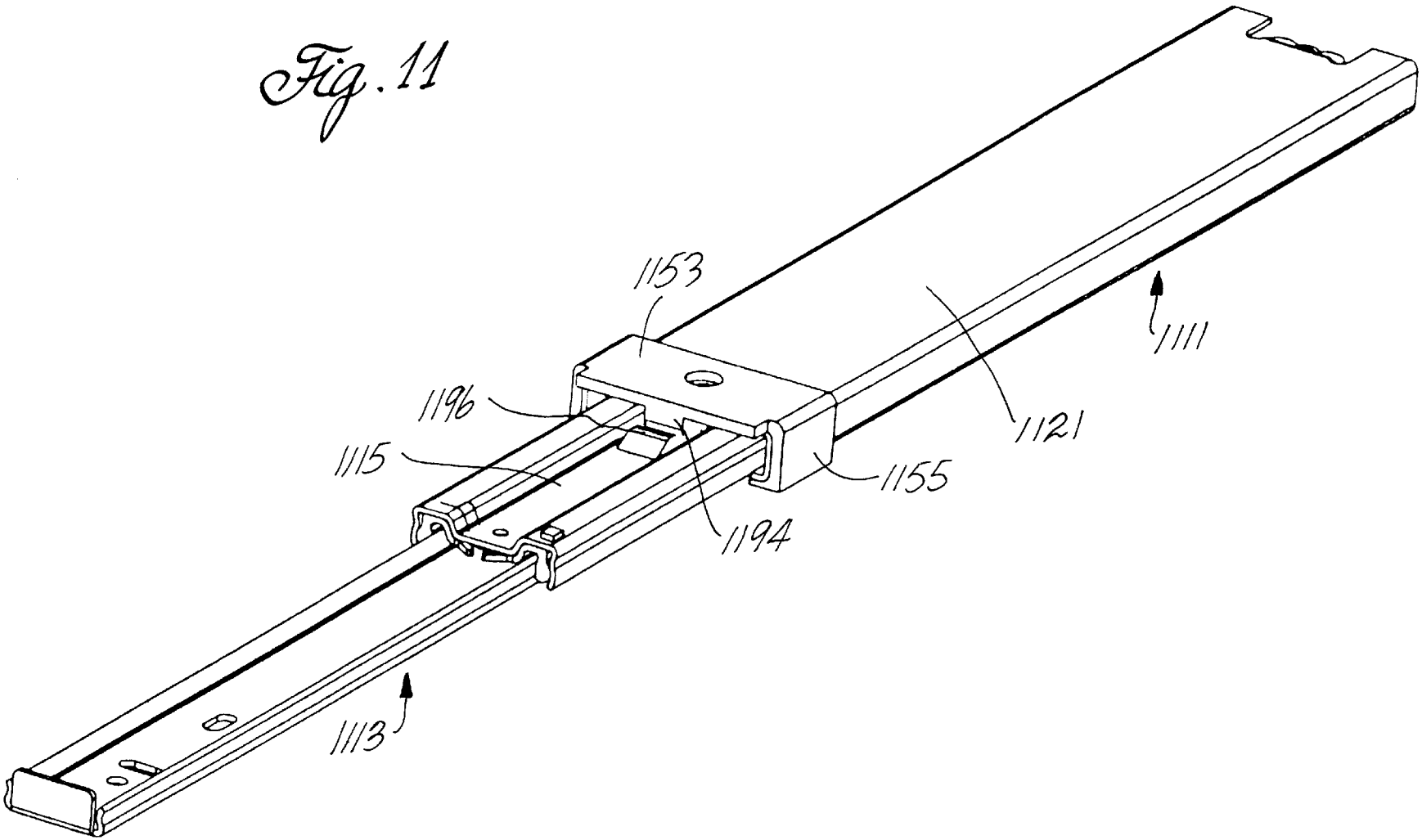
FIG. 11 illustrates a perspective view of a telescopic drawer slide incorporating a detent mechanism of the present invention.

FIG. 11 illustrates a concept of the present invention applied to a telescopic drawer slide. More particularly, FIG. 11 illustrates a telescopic drawer slide having a detent position when the drawer slide is in neither the fully retracted or the fully extended position. As previously stated, the telescopic drawer slide has slide members nested within one another. Thus, in the three member drawer slide illustrated in FIG. 11 an outer slide member 1111 and an inner slide member 1113 are coupled together by bearings and an intermediate slide member having a substantially planar web 1115. An end piece having a planar web 1153 with opposing flanges 1155*a,b* extending from the web is coupled to the outer slide member. As illustrated, the end piece is largely wrapped around the outside of the outer slide member, and therefore has a shape substantially similar to that of the outer slide member. Along the mid-portion of the web a finger 1194 extends from the web, past a web 1121 of the outer slide member, and towards the web 1115 of the intermediate slide member. Protruding from the surface above the intermediate slide member is a bump 1196. The finger 1194 extends sufficiently close to the web of the intermediate slide member such that, during course of travel of the intermediate slide member, the bump contacts the finger, thereby forming a frictional interface. Thus, the finger and bump together form a detent mechanism. As discussed with respect to the other embodiments, variations in the shape and height of the bump, as well as the shape and length of the finger, as well as providing multiple bumps, allows for variations in the operation of the detent mechanism.

Accordingly, the present invention provides detent mechanisms for drawer slides. Although this invention has been described in certain specific embodiments, many additional modifications and variations would be apparent to those skilled in the art. It is therefore to be understood that this invention may be practiced otherwise than as specifically described. Thus the present embodiments of the invention should be considered in all respects as illustrative and not restrictive, the scope of the invention to be determined by the appended claims and their equivalents rather than the foregoing description.

What is claimed is:

1. A drawer slide including a detent mechanism comprising:

a first slide member with a first bumper;

a second slide member slidably coupled to the first slide member, the second slide member having a protrusion, the protrusion having a first sloping surface contacted by the first bumper when the first slide member and the second slide member are moving towards the retracted position, and the protrusion having a second sloping surface contacted by the first bumper when the first slide member and the second slide member are moving towards the extended position, wherein the first sloping surface has a first angle of inclination, the second sloping surface has a second angle of inclination, and the first angle of inclination and the second angle of inclination are not the same;

the first slide member and the second slide member having a retracted position with respect to one another and an extended position with respect to one another, and are slidably extendable from the retracted position to the extended position along a travel path;

wherein the first bumper contacts the protrusion when the first slide member and the second slide member are in a predefined position between the retracted position and the extended position.

2. The drawer slide including a detent mechanism of claim 1 wherein the protrusion is an emboss formed on the second slide member.

3. The drawer slide including a detent mechanism of claim 2 wherein the second slide member comprises a pair of bearing raceways coupled by a longitudinal web, and the emboss is formed on at least one of the bearing raceways.

4. The drawer slide including a detent mechanism of claim 3 wherein the emboss is formed on an upper surface of a bearing raceway of the second slide member.

5. The drawer slide including a detent mechanism of claim 3 wherein the emboss is formed on a side surface of a bearing raceway of the second slide member.

6. The drawer slide including a detent mechanism of claim 5 wherein the first bumper contacts the bearing raceway of the second slide member.

7. A parallel drawer slide with detent comprising:

a first slide member and an opposing slide member, the first slide member and the opposing slide member each being comprised of planar webs interconnecting bearing raceways, and an intermediate slide member disposed between the first slide member and the opposing slide member, the intermediate slide member having a central web and a pair of bearing raceways on opposing margins of the central web, the first slide member and the opposing slide member each being slidably coupled to the intermediate slide member by bearings in the bearing raceways;

an emboss on an outer surface of the bearing raceway of the opposing slide member; and a flange coupled to the first slide member, the flange extending in the direction of the opposing slide member a sufficient distance such that the flange contacts and rides over the emboss during motion of the first slide member with respect to the opposing slide member.

8. The parallel drawer slide with detent of claim 7 wherein the flange is part of a bumper coupled to the first slide member.

9. The parallel drawer slide with detent of claim 8 wherein the flange includes an inner surface having a receiving cup adapted to receive the emboss.

10. The parallel drawer slide with detent of claim 9 wherein the inner surface of the flange has chamfered edges.

11. The parallel drawer slide with detent of claim 10 wherein the flange is coupled to a tongue extending from the planar web of the first slide member.

12. The parallel drawer slide with detent of claim 11 wherein the emboss has a first sloping surface contacted by the flange when motion of the first slide member and the second slide member are in a first direction and the emboss has a second sloping surface contacted by the flange when motion of the first slide member and the second slide member are in a second direction.

13. The parallel drawer slide with detent of claim 12 wherein the first sloping surface has a first angle of inclination, the second sloping surface has a second angle of inclination, and the first angle of inclination and the second angle of inclination are not the same.

* * * * *